US011347167B2

(12) United States Patent
Yokoyama

(10) Patent No.: US 11,347,167 B2
(45) **Date of Patent: *May 31, 2022**

(54) FIXING DEVICE AND IMAGE FORMING DEVICE

(71) Applicant: TOSHIBA TEC KABUSHIKI KAISHA, Tokyo (JP)

(72) Inventor: Shuji Yokoyama, Nagaizumi Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/142,281

(22) Filed: Jan. 6, 2021

(65) Prior Publication Data

US 2021/0124292 A1 Apr. 29, 2021

Related U.S. Application Data

(63) Continuation of application No. 16/850,090, filed on Apr. 16, 2020, now Pat. No. 10,915,044, which is a continuation of application No. 16/268,537, filed on Feb. 6, 2019, now Pat. No. 10,656,571.

(51) Int. Cl.
*G03G 15/20* (2006.01)

(52) U.S. Cl.
CPC ..... *G03G 15/2025* (2013.01); *G03G 15/2053* (2013.01)

(58) Field of Classification Search
CPC ..... G03G 15/2017; G03G 15/2025; G03G 15/2053
See application file for complete search history.

(56) References Cited

U.S. PATENT DOCUMENTS 10,915,044 B2 * 2/2021 Yokoyama ..... G03G 15/2053
2016/0274515 A1 9/2016 Imada et al.
2016/0378029 A1 12/2016 Itoh et al.

FOREIGN PATENT DOCUMENTS

JP 2014-178520 9/2014

OTHER PUBLICATIONS

Non-Final Office Action for U.S. Appl. No. 16/268,537 dated Jul. 23, 2019.
Non-Final Office Action for U.S. Appl. No. 16/850,090 dated Jun. 24, 2020.
Extended European Search Report for European Patent Application No. 20150940.3 dated Jun. 22, 2020.
U.S. Appl. No. 16/850,090, filed Apr. 16, 2020.
U.S. Appl. No. 16/268,537, filed Feb. 6, 2019.

* cited by examiner

*Primary Examiner* — Hoang X Ngo
(74) *Attorney, Agent, or Firm* — Amin, Turocy & Watson, LLP

(57) ABSTRACT

According to one embodiment, a fixing device fixes a toner image formed on a medium to the medium. The fixing device includes a heating rotator which is rotatably supported, an auxiliary heating member which is disposed along an inner circumferential surface of the heating rotator, and swings as the heating rotator rotates, a lubricant supply member which is disposed at a position on which the swing auxiliary heating member abuts, and is impregnated with a lubricant, and a pressing rotator which abuts on the heating rotator, and forms a nip portion through which the medium passes.

20 Claims, 13 Drawing Sheets

FIXING DEVICE AND IMAGE FORMING DEVICE

CROSS-REFERENCE TO RELATED APPLICATIONS

This application is a Continuation of application Ser. No. 16/850,090 filed on Apr. 16, 2020, which is a Continuation of application Ser. No. 16/268,537 filed on Feb. 6, 2019, the entire contents of both of which are incorporated herein by reference.

FIELD

An embodiment described herein relates generally to a fixing device and an image forming device.

BACKGROUND

An image forming device such as a multi-function peripheral or a laser printer includes a fixing device to fix a toner image to a paper sheet. The fixing device transfers heat of a heater to the paper sheet through a fixing belt, for example, to fix the toner image transferred onto the paper sheet to the paper sheet. With this configuration, an image and a character are printed to the paper sheet.

In such a type of the fixing device, a pressing roller is pressed to a pressing pad disposed inside the fixing belt through the fixing belt, so that a nip portion, through which the paper sheet passes, is formed between the fixing belt and the pressing roller. Therefore, when the paper sheet passes through the nip portion, and the fixing belt and the pressing roller rotate, an inner circumferential surface of the fixing belt slides with respect to the pressing pad. Thus, the inner circumferential surface of the fixing belt is coated with a lubricant such as silicon oil in order to reduce frictional resistance between the fixing belt and the pressing pad.

However, the silicon oil is, for example, leaked out from the ends of the fixing belt and thus reduced in amount. Therefore, a sliding property between the fixing belt and the pressing pad is degraded as the device operates.

DETAILED DESCRIPTION

In general, according to one embodiment, a fixing device fixes a toner image formed in a medium to the medium, and includes a heating rotator which is configured to be rotatably supported, an auxiliary heating member which is configured to be disposed along an inner circumferential surface of the heating rotator, and to swing as the heating rotator rotates, a lubricant supply member which is configured to be disposed at a position where the swinging auxiliary heating member abuts, and to be impregnated with a lubricant, and a pressing rotator which is configured to abut on the heating rotator, and to form a nip portion through which the medium passes.

Hereinafter, an image forming device according to this embodiment will be described with reference to the drawings. In the description, an XYZ coordinate system constituted with X, Y, and Z axes perpendicular to each other will be appropriately used.

Figure 1:
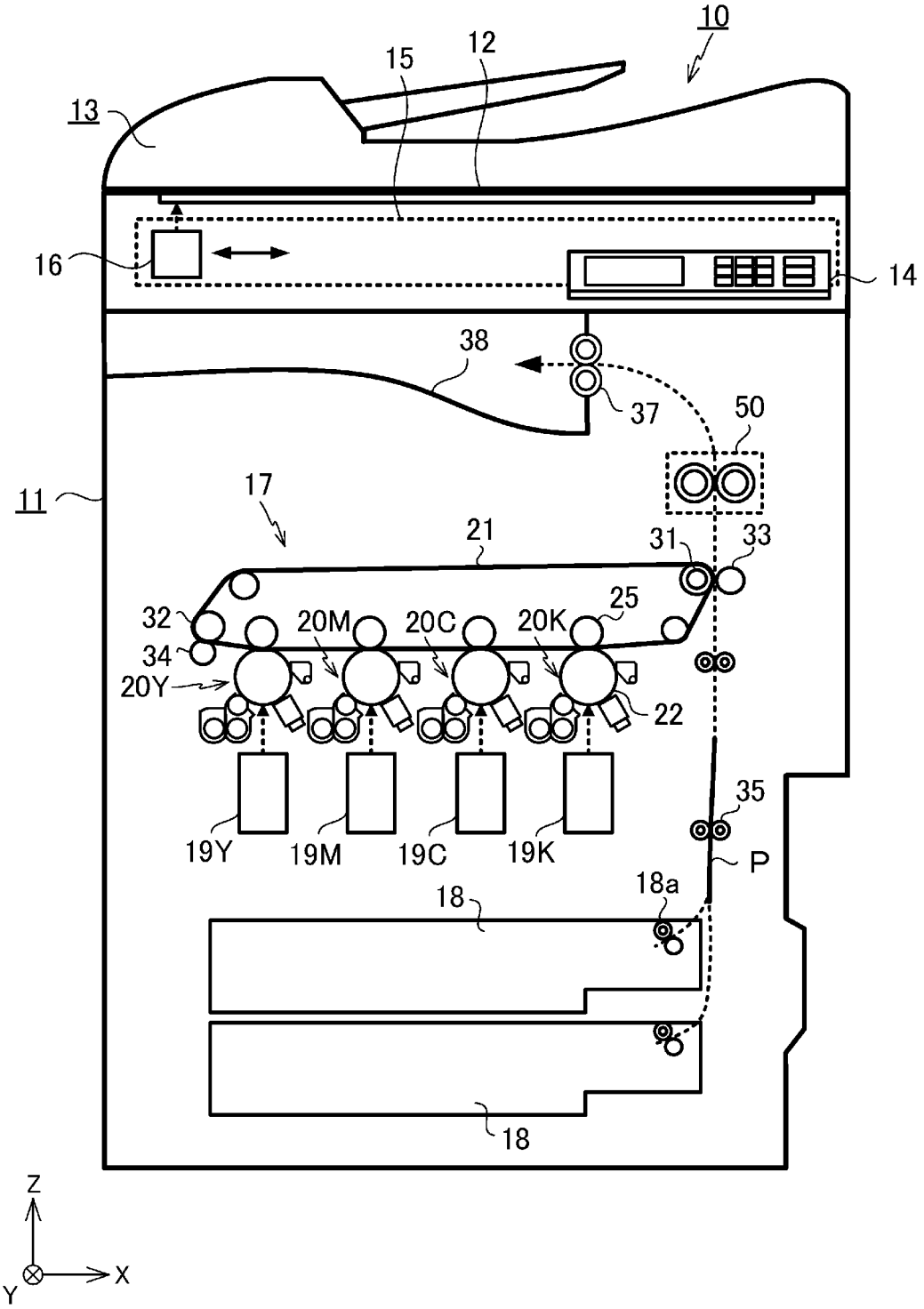
FIG. 1 is a diagram schematically illustrating a configuration of an image forming device according to an embodiment.

FIG. 1 is a diagram schematically illustrating the configuration of an image forming device 10 according to this embodiment. The image forming device 10 is, for example, a multi-function peripherals (MFP). The image forming device 10 includes a main body 11 and an automatic document feeder (ADF) 13 which is disposed on the upper side of the main body 11. An original document table 12 made of transparent glass is disposed on the upper portion of the main body 11. On the upper surface side of the original document table 12, there is provided the automatic document feeder (ADF) 13 which can be pivoted to an erected position. In addition, an operation panel 14 is provided in the upper portion of the main body 11. The operation panel includes various types of keys, a GUI (Graphical User Interface) and the like.

A scanner 15 is provided on the lower side of the original document table 12 to read the original document. The scanner 15 reads the original document sent by the automatic document feeder 13 or the original document placed on the original document table 12 to generate image data. The scanner 15 includes an image sensor 16.

The image sensor 16 reads an image of the original document while moving in a +X direction along the original document table 12 when reading the image of the original document placed on the original document table 12. In addition, when reading the image of the original document supplied by the automatic document feeder 13 to the original document table 12, the image sensor 16 is fixed at a position illustrated in FIG. 1, and reads the image of each of sequentially-sent original documents.

An image forming unit 17 is disposed in the inner portion of the main body 11. The image forming unit 17 forms a toner image in a recording medium such as a paper sheet stored in a sheet cassette 18 on the basis of the image data read by the scanner 15 or the image data created by a personal computer.

The image forming unit 17 includes image forming units 20Y, 20M, 20C, and 20K which form latent images using toners of Yellow (Y), Magenta (M), Cyan (C), and Black (K), scanning heads 19Y, 19M, 19C, and 19K which are provided corresponding to the image forming units, and an intermediate transfer belt 21.

The image forming units 20Y, 20M, 20C, and 20K are disposed on the lower side of the intermediate transfer belt 21. In the image forming unit 17, the image forming units 20Y, 20M, 20C, and 20K are arranged from a −X side to a +X side. The scanning heads 19Y, 19M, 19C, and 19K are disposed on the lower side of the image forming units 20Y, 20M, 20C, and 20K respectively.

Figure 2:
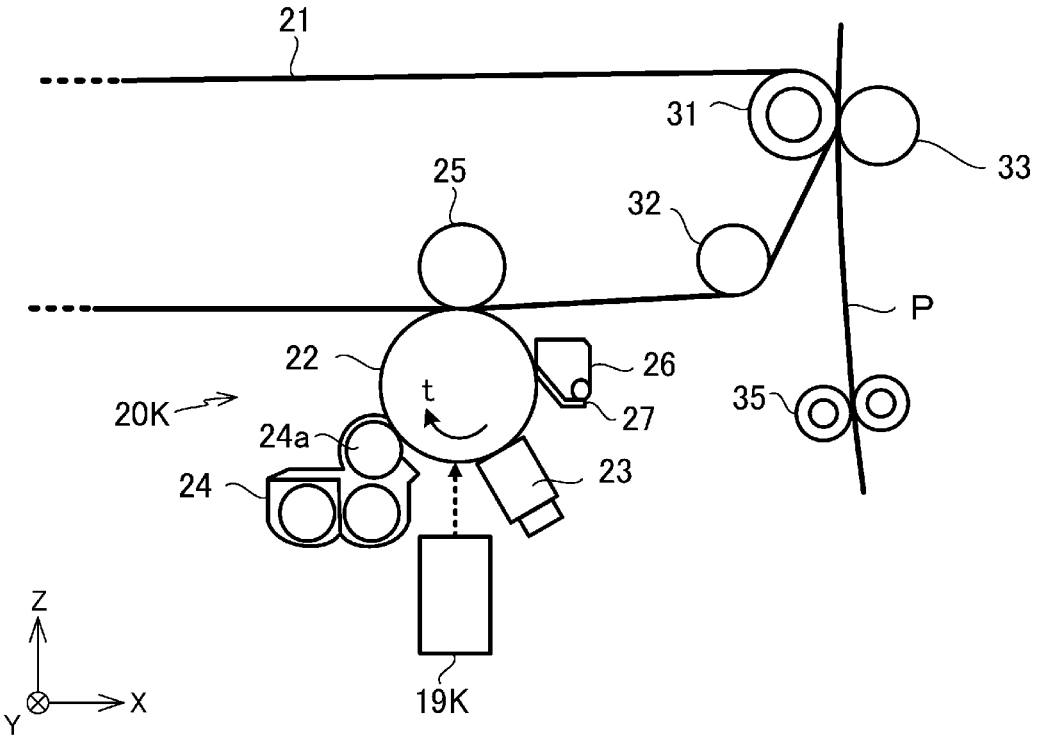
FIG. 2 is a diagram illustrating an image forming unit on a magnified scale.

FIG. 2 is a diagram illustrating the image forming unit 20K among the image forming units 20Y, 20M, 20C, and 20K on an enlarged scale. The image forming units 20Y, 20M, 20C, and 20K have the equal configuration. Therefore, the configuration of the image forming unit will be described by taking the image forming unit 20K as an example.

The image forming unit 20K includes a photosensitive drum 22 which is an image carrying member. An electrification charger 23, a developing unit 24, a primary transfer roller 25, and a cleaner 26 are disposed along a direction indicated by arrow t around the photosensitive drum 22. A laser beam is emitted from the scanning head 19K to an exposure position of the photosensitive drum 22. When the laser beam is emitted to the surface of the rotating photosensitive drum 22, an electrostatic latent image is formed on the surface of the photosensitive drum 22.

The electrification charger 23 of the image forming unit 20K evenly charges the surface of the photosensitive drum 22 with electricity. The developing unit 24 supplies the toner to the photosensitive drum 22 by a developing roller 24*a* to which a developing bias is applied, and develops the electrostatic latent image. The cleaner 26 peels and removes the toner remained on the surface of the photosensitive drum 22 using a blade 27. The toner peeled by the blade 27 is collected by the cleaner 26.

As illustrated in FIG. 1, the intermediate transfer belt 21 is stretched on a driving roller 31 and three driven rollers 32. The intermediate transfer belt 21 turns left in FIG. 1 as the driving roller 31 rotates. In addition, as illustrated in FIG. 1, the intermediate transfer belt 21 comes into contact to each upper surface of the photosensitive drums 22 of the image forming units 20Y, 20M, 20C, and 20K. To a position of the intermediate transfer belt 21 facing the photosensitive drum 22, a primary transfer voltage is applied by the primary transfer roller 25. With this configuration, the toner image which is developed on the surface of the photosensitive drum 22 is primarily transferred to the intermediate transfer belt 21.

A secondary transfer roller 33 is disposed to face the driving roller 31 which stretches the intermediate transfer belt 21. When a paper sheet P passes between the driving roller 31 and the secondary transfer roller 33, a secondary transfer voltage is applied to the paper sheet P by the secondary transfer roller 33. With this configuration, the toner image formed on the intermediate transfer belt 21 is secondarily transferred to the paper sheet P. A belt cleaner 34 is provided near the driven roller 32 of the intermediate transfer belt 21 as illustrated in FIG. 1. The residual toner of the surface of the intermediate transfer belt 21 is removed by the belt cleaner 34.

As illustrated in FIG. 1, a sheet feeding roller 35 is provided between the sheet cassette 18 and the secondary transfer roller 33. The paper sheet P taken out by a pickup roller 18*a* disposed near the sheet cassette 18 from the sheet cassette 18 is carried between the intermediate transfer belt 21 and the secondary transfer roller 33 by the sheet feeding roller 35.

A fixing device 50 is provided on the upper side of the secondary transfer roller 33. In addition, a sheet discharge roller 37 is provided on the upper side of the fixing device 50. The paper sheet P which is passed through the intermediate transfer belt 21 and the secondary transfer roller 33 is heated by the fixing device 50. With this configuration, the toner image is fixed to the paper sheet P. The paper sheet P which is passed through the fixing device 50 is discharged to a sheet discharge unit 38 by the sheet discharge roller 37.

Figure 3:
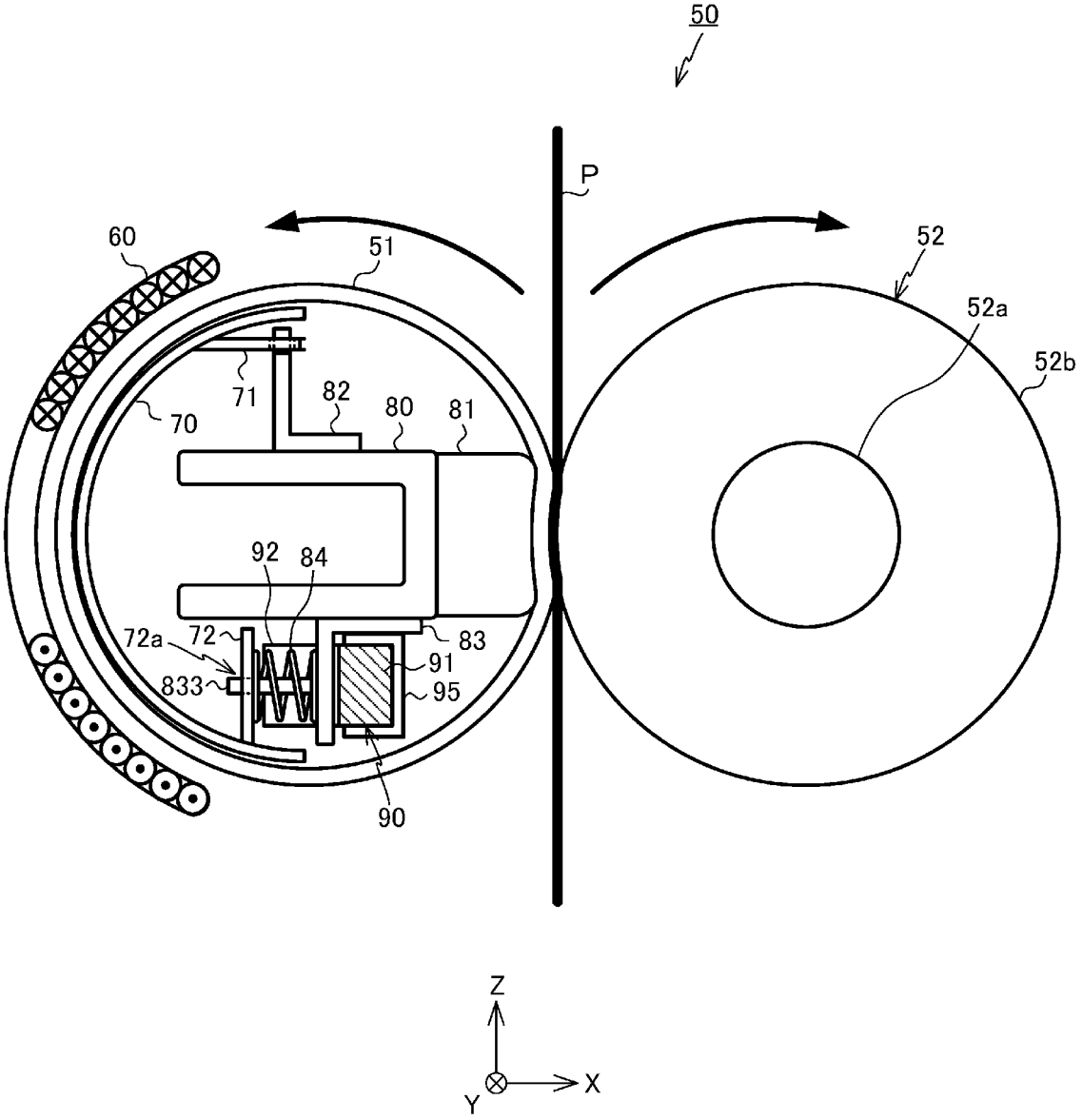
FIG. 3 is a diagram illustrating an example of a fixing device.

FIG. 3 is a diagram illustrating an example of the fixing device 50. The fixing device 50 includes a fixing belt 51, a pressing roller 52, a base member 80 which is disposed inside the fixing belt 51, a pressing pad 81 which is supported by the base member 80, a magnetic shunt member 70 as an auxiliary heating member, a lubricant supply member 90, and a heating coil 60 which is disposed along the outer periphery of the fixing belt 51.

The fixing belt 51 is a member formed in a cylindrical shape of which the longitudinal direction is a Y axis direction, and the length is larger than the width (a dimension in Y axis direction) of the paper sheet P. In addition, the thickness of the fixing belt 51 is about 300 μm. The fixing belt 51 is made of a polyimide film as a base material which has heat resistance and is 70 μm in thickness. On the surface of the material, for example, a heating layer, a decoding functional layer, an elastic layer, and a protection layer are formed to be stacked.

The heating layer is a copper layer, and the decoding layer is a nickel layer. The elastic layer is a silicon rubber layer of about 200 μm thickness. The elastic layer is coated with a protection layer made of a PFA (perfluoroalkoxy alkane) resin. The fixing belt 51 is supported to rotate about an axis in parallel with the Y axis. On an inner circumferential surface of the fixing belt 51, silicon oil is coated as a lubricant.

The base member 80 is a member of which the longitudinal direction is set to the Y axis direction, and the cross section is a U shape. The base member 80 has almost the same length as the fixing belt 51, and is horizontally supported to be parallel to the Y axis.

Figure 4:
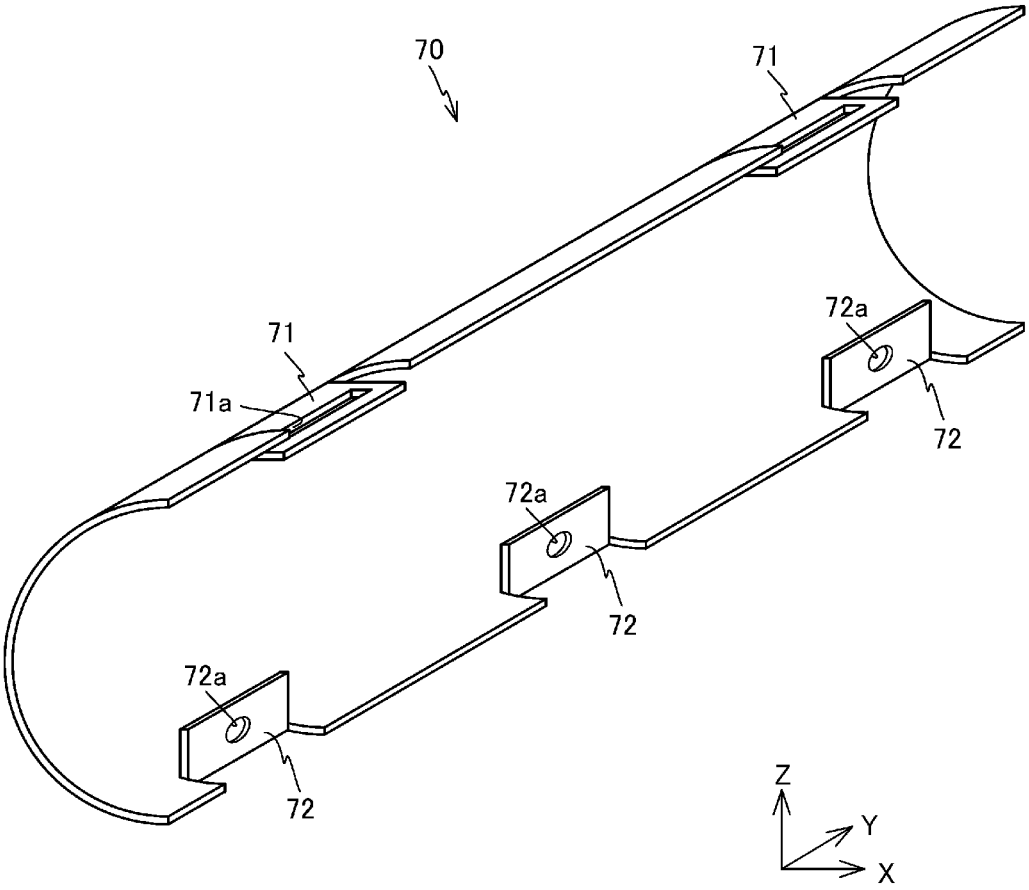
FIG. 4 is a perspective view illustrating a magnetic shunt member.

FIG. 4 is a perspective view of the magnetic shunt member 70. The magnetic shunt member 70 is a member of which the longitudinal direction is set to the Y axis direction. The magnetic shunt member 70 is formed in a semicircular shape. The magnetic shunt member 70 is made of a magnetic shunt alloy of which the permeability changes according to temperature. The magnetic shunt member 70 has a property of changing in magnetism when being heated to the Curie temperature or higher. While different depending on the application of the image forming device 10, the Curie temperature of the magnetic shunt member 70 is about 200° C. The magnetic shunt member 70 is made of an alloy of iron and nickel for example.

As illustrated in FIG. 4, a pair of fixing device portions 71 are formed at the upper end of the magnetic shunt member 70 for example. Each of the pair of fixing device portions 71 is formed in a rectangular shape of which the longitudinal direction is set to the Y axis direction, and is parallel to the XY plane. At the center of each fixing device portion 71, an opening 71*a* is formed in a rectangular shape of which the longitudinal direction is set to the Y axis direction. In addition, at the lower end of the magnetic shunt member 70, three abutment portions 72 are formed at an equal interval in the Y axis direction for example. Each abutment portion 72 is formed in a rectangular shape of which the longitudinal direction is set to the Y axis direction, and is parallel to the YZ plane. In addition, at the center of the abutment portion 72, an opening 72*a* is provided to pass through in the X axis direction. The magnetic shunt member 70 which includes the fixing device portion 71 and the abutment portion 72 may be integrally formed by performing sheet metal working on a magnetic shunt alloy for example.

Figure 5:
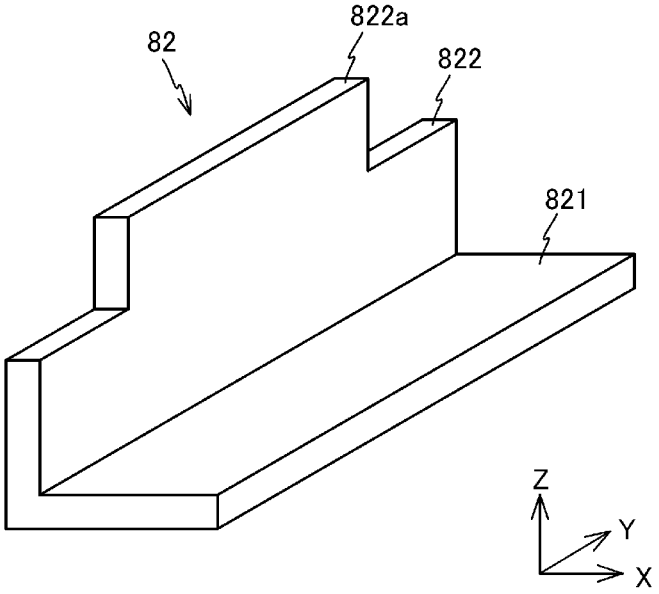
FIG. 5 is a perspective view illustrating a support member.

The magnetic shunt member 70 is supported to be swung by a support member 82 as illustrated in FIG. 3. FIG. 5 is a perspective view of the support member 82. As illustrated in FIG. 5, the support member 82 is a member of which the XZ cross section is an L shape. The support member 82 is made of an iron or stainless steel plate, and includes a fixing device portion 821 parallel to the XY plane and a supporting portion 822 parallel to the YZ plane. At the upper end of the supporting portion 822, there is formed a protruding portion 822*a* of which the width in the Y axis direction is smaller than the supporting portion 822. The support member 82 is mounted on the base member 80 by fixing the fixing device portion 821 to the upper surface of the base member 80.

Figure 6:
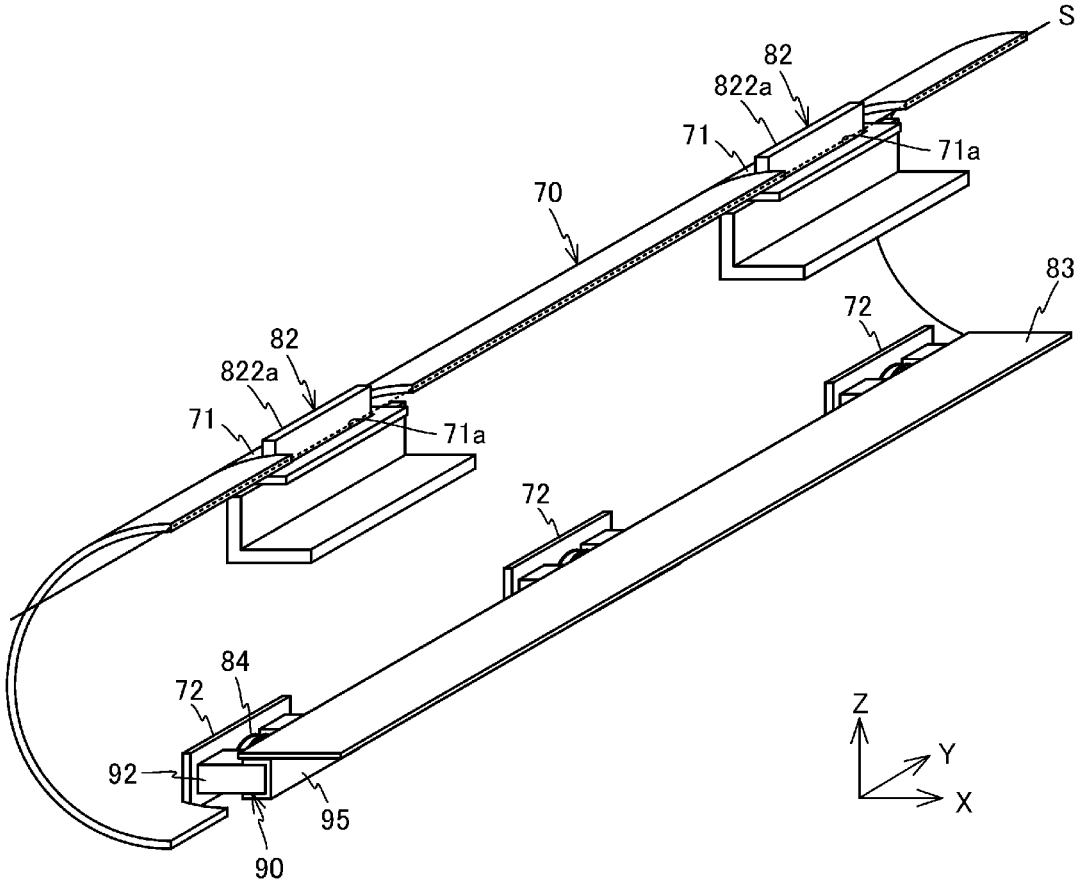
FIG. 6 is a diagram illustrating the magnetic shunt member which is supported to the support member.

FIG. 6 is a diagram illustrating the magnetic shunt member 70 which is supported to the support member 82. As illustrated in FIG. 6, the magnetic shunt member 70 is supported to the support member 82 in a state where the protruding portion 822*a* of the support member 82 is inserted to the opening 71*a* of the fixing device portion 71. The thickness of the protruding portion 822*a* of the support member 82 is smaller than the width (the magnitude in the X axis direction) of the opening 71*a* of the magnetic shunt member 70. Therefore, the magnetic shunt member 70 swings about the opening 71*a* in a state where the position in the YX plane is restricted by the protruding portion 822*a*. Since the magnetic shunt member 70 is supported by the support members 82 separated in the Y axis direction, the magnetic shunt member can swing about a virtual axis S parallel to the inner circumferential surface of the fixing belt 51.

As illustrated in FIG. 3, the magnetic shunt member 70 comes to abut on the inner circumferential surface of the fixing belt 51 as the abutment portion 72 is pressed in a −X direction by a spring 84. The spring 84 is a pressing spring, and is supported by a support plate 83 which is fixed to the lower surface of the base member 80.

Figure 7:
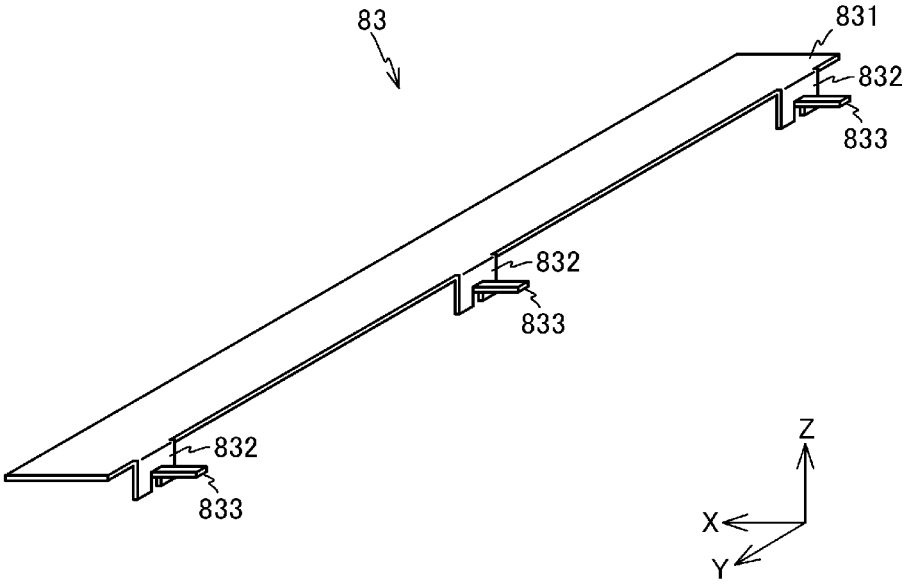
FIG. 7 is a perspective view illustrating a support plate.

FIG. 7 is a perspective view of the support plate 83. The support plate 83 is, for example, a member which is made of an iron or stainless steel plate and has the longitudinal direction in the Y axis direction. The support plate 83 includes a main body 831 parallel to the XY plane, and three U-shaped claws 832 which extend in the vertical downward direction (−Z direction) from the end on the −X side of the main body 831. In addition, on the claw 832, there is formed a protruding portion 833 of a rectangular plate shape which extends in the −X direction. The length in the X axis direction of the protruding portion 833 is adjusted to be longer than a natural length of the spring 84. The support plate 83 having the above configuration can be integrally formed by performing sheet metal working on an iron or stainless steel plate for example.

Figure 8:
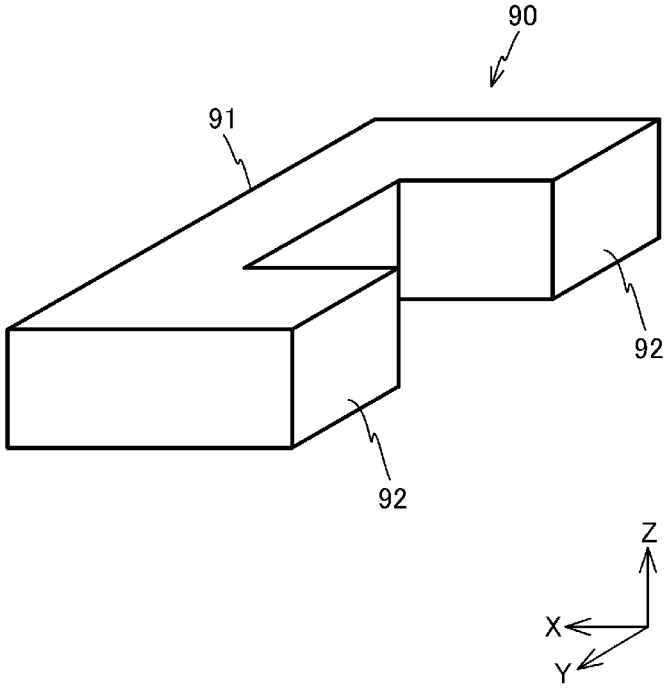
FIG. 8 is a perspective view illustrating a lubricant supply member.

FIG. 8 is a perspective view of the lubricant supply member 90. The lubricant supply member 90 is, for example, a U-shaped member made of a liquid absorbing material such as aramid fiber, melamine resin, and glass fiber. The lubricant supply member 90 is made of a main body 91 of a cuboid shape parallel to the Y axis, and a pair of convex portions 92 which protrude from both ends of the main body 91 in the −X direction. The lubricant supply member 90 is impregnated with silicon oil in advance.

Figure 9:
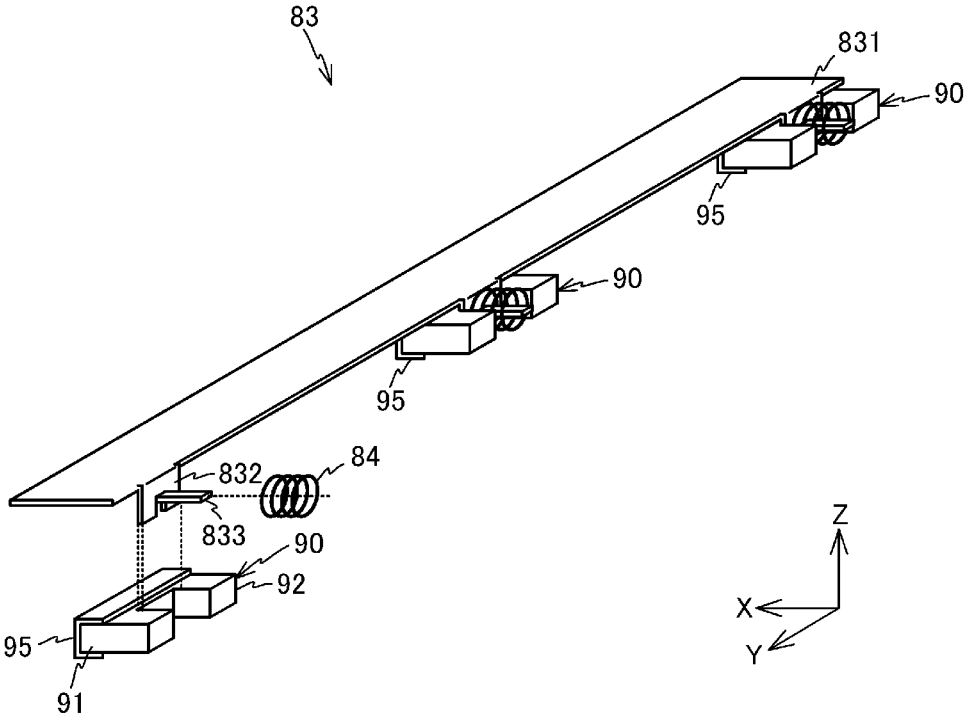
FIG. 9 is a diagram for describing a mounting method of a spring and the lubricant supply member.

The spring 84 and the lubricant supply member 90 are mounted to the support plate 83. FIG. 9 is a diagram for describing a mounting method of the spring 84 and the lubricant supply member 90 to the support plate 83. As illustrated in FIG. 9, the spring 84 is fixed, in a state where the protruding portion 833 is inserted, to the surface on the −X side of three claws 832 which are provided in the support plate 83.

To the lubricant supply member 90, a grasping member 95 is mounted. The grasping member 95 is a metal member of which the XZ cross section is formed in the U shape. The main body 91 of the lubricant supply member 90 is gripped to the grasping member 95. Then, the grasping member 95 is mounted to the lower surface of the main body 831 of the support plate 83, and the lubricant supply member 90 is supported in a state where two convex portions 92 are located on both sides in the Y axis direction of the spring 84. The end on the −X side of the convex portion 92 of the lubricant supply member 90 may be equal to the end on the −X side of the spring 84, or located slightly in the +X side.

As illustrated in FIG. 3, the support plate 83 where the spring 84 and the lubricant supply member 90 are mounted is mounted in the lower surface of the base member 80, and the abutment portion 72 formed in the magnetic shunt member 70 is biased in the −X direction by the spring 84. With this configuration, the magnetic shunt member 70 is pressed to the inner circumferential surface on the −X side of the fixing belt 51. In addition, in this state, the convex portion 92 of the lubricant supply member 90 slightly abuts on the abutment portion 72. When the support plate 83 is fixed to the lower surface of the base member 80, the protruding portion 833 of the support plate 83 passes through the opening 72*a* which is provided in the abutment portion 72 of the magnetic shunt member 70. With this configuration, falling-off or position mismatch of the spring 84 is prevented.

Figure 10:
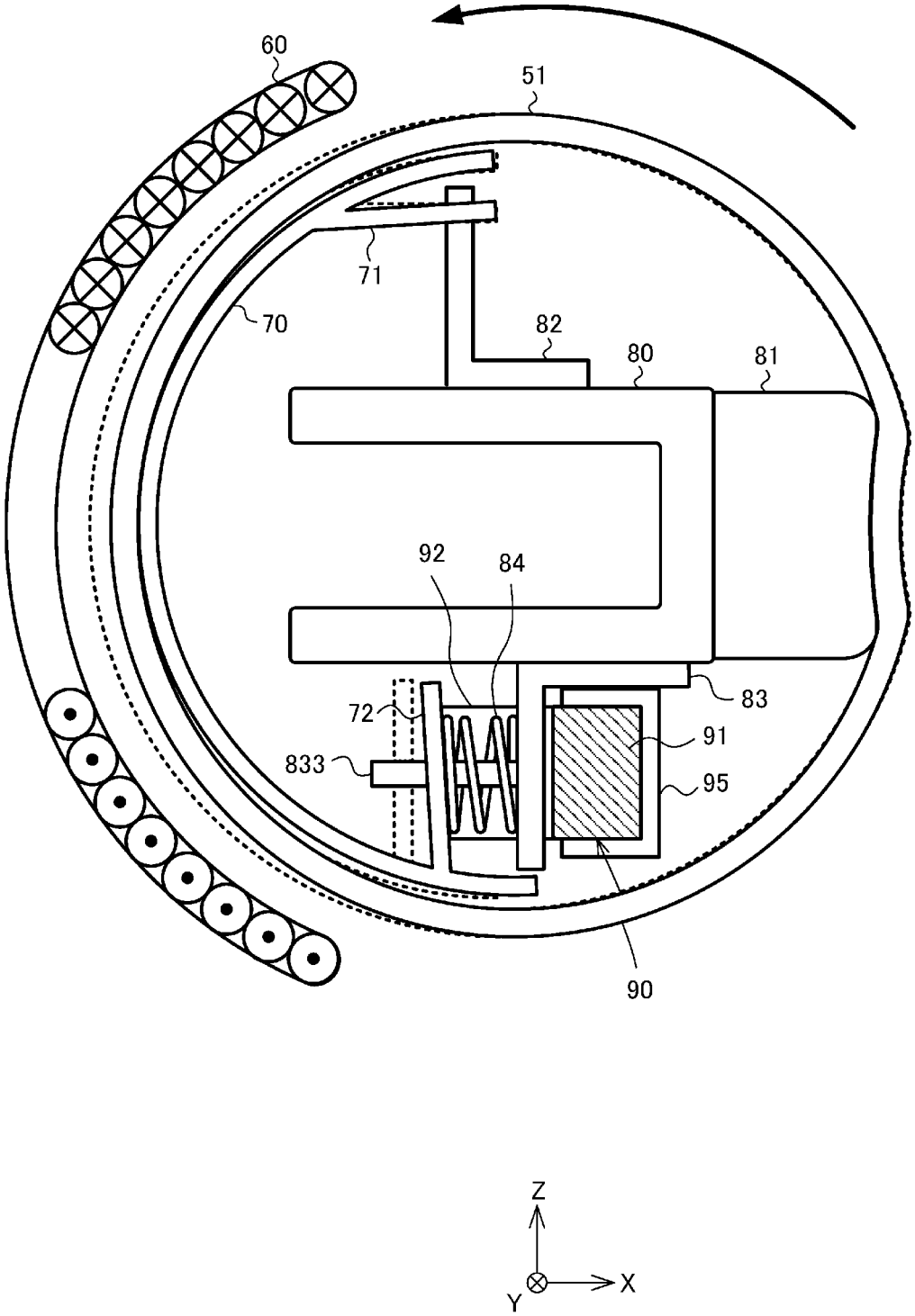
FIG. 10 is a diagram for describing a movement of the magnetic shunt member.

While being shaped in a cylindrical shape, the fixing belt 51 is not the perfect circle in the XZ cross-sectional shape due to an influence of flexibility and viscoelasticity of the fixing belt 51 or the abutment of the pressing roller 52. Therefore, when the fixing belt 51 rotates, the magnetic shunt member 70 slides along the inner circumferential surface of the fixing belt 51 and thus swings about a fulcrum of the support member 82. As a result, the magnetic shunt member 70 is repeatedly moved between the position indicated with a broken line and the position indicated with a solid line in FIG. 10.

When the magnetic shunt member 70 swings as described above, the convex portion 92 of the lubricant supply member 90 repeatedly expands and contracts by the abutment portion 72 of the magnetic shunt member 70. As a result, the silicon oil flows from the lubricant supply member 90 according to a contracting amount or the number of expanding and contracting, and dropped to the inner circumferential surface of the fixing belt 51. As long as the fixing belt 51 rotates continuously, the lubricant supply member 90 intermittently contracts, and the silicon oil is continuously dropped to the inner circumferential surface of the fixing belt 51.

Returning to FIG. 3, the pressing pad 81 is a member of which the Y axis direction is set to the longitudinal direction. The pressing pad 81 is made of poly phenylene sulfide resin (PPS), liquid crystal polymer (LCP), or phenol resin (PF) for example. The abutment surface (the surface on the +X side) of the pressing pad 81 becomes a curved surface bent along the side surface of the pressing roller 52. On the abutment surface of the pressing pad 81, a sheet or the like which is excellent in, for example, a sliding property and an abrasion resistance property is bonded. Examples of such a type of sheets include a material made of glass cloth or the like.

The pressing roller 52 is a member of a cylindrical shape of which the longitudinal direction is set to the Y axis direction. The pressing roller 52 includes a core material 52*a* made of metal such as aluminum, and a silicon rubber layer 52*b* which is stacked on the outer circumferential surface of the core material. The surface of the silicon rubber layer 52*b* is coated with a PFA (perfluoroalkoxy fluorin resin) resin. The pressing roller 52 is configured such that the outer diameter is about 25 mm and the length is almost equal to the length of the fixing belt 51. The pressing roller 52 is biased by an elastic member (not illustrated) in a direction (−X direction) facing the fixing belt 51. With this configuration, the pressing roller 52 is pressed to the pressing pad 81 through the fixing belt 51. Then, the surface of the pressing roller 52 and the surface of the fixing belt 51 come into tight contact with each other to form a nip portion through which the paper sheet P passes from the lower side to the upper side (+Z direction).

The heating coil 60 is disposed along the outer circumferential surface of the fixing belt 51. The heating coil 60 faces the magnetic shunt member 70 through the fixing belt 51. In the heating coil 60, a high-frequency voltage is applied by a fixing control circuit 150 which is described below. When a high-frequency voltage is applied to the heating coil 60, eddy current flows in the fixing belt 51 due to an electromagnetic induction, and the fixing belt 51 generates heat.

In the fixing device 50 described above, as the pressing roller 52 rotates, the paper sheet P passes through the nip portion between the pressing roller 52 and the fixing belt 51 which rotate in the directions of arrows illustrated in FIG. 3. With this configuration, the paper sheet P is heated by the fixing belt 51 generating heat, and the toner image formed on the paper sheet P is fixed to the paper sheet P.

Figure 11:
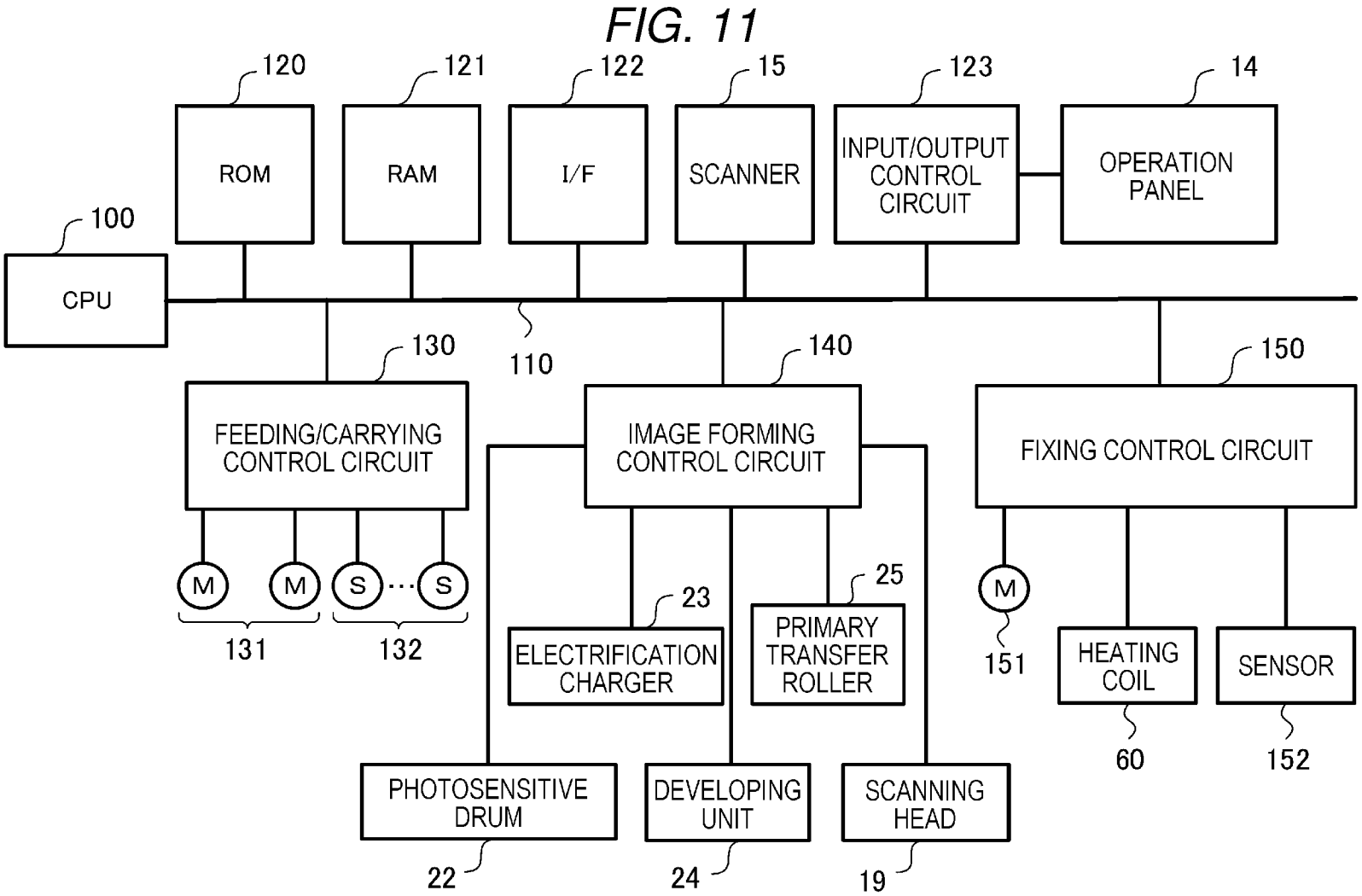
FIG. 11 is a block diagram illustrating a control system of the image forming device.

FIG. 11 is a block diagram of a control system of the image forming device 10. The control system includes, for example, a CPU 100 which controls the entire image forming device, a bus line 110, a read only memory (ROM) 120, a random access memory (RAM) 121, an interface 122, the scanner 15, an input/output control circuit 123, a feeding/carrying control circuit 130, an image forming control circuit 140, and the fixing control circuit 150. The CPU 100 and the respective circuits are connected through the bus line 110.

The ROM 120 stores a control program and control data which regulate basic operations of the image forming process.

The RAM 121 serves as a working memory which is a work area of the CPU 100.

The CPU 100 performs the program stored in the ROM 120. With this configuration, the components of the image forming device 10 are collectively controlled by the CPU 100, and the processes of forming an image on the paper sheet are sequentially implemented.

The interface 122 communicates with a device such as a user's terminal. The input/output control circuit 123 displays information in the operation panel 14, and receives an input from the operation panel 14. The user of the image forming device 10 may operate the operation panel 14 to designate the size of the paper sheet or the number of copies of the original document.

The feeding/carrying control circuit 130 is a unit which controls the pickup roller 18*a*, the sheet feeding roller 35, or a motor group 131 driving the sheet discharge roller 37 and the like in the conveyance path. The feeding/carrying control circuit 130 controls the motor group 131 according to a control signal from the CPU 100 or a detection result of various types of sensors 132 provided near or in the conveyance path of the sheet cassette 18.

The image forming control circuit 140 controls the photosensitive drum 22, the electrification charger 23, the scanning heads 19Y, 19M, 19C, and 19K, the developing unit 24, and the primary transfer roller 25 respectively on the basis of the control signal from the CPU 100.

The fixing control circuit 150 controls a driving motor 151 which rotates the pressing roller 52 of the fixing device 50 on the basis of the control signal from the CPU 100. In addition, the fixing control circuit 150 drives the heating coil 60 on the basis of the output from a sensor 152 detecting the temperature of the fixing belt 51, a size of the paper sheet P notified from the CPU or the like.

In the image forming device 10, an image forming process is performed for printing on the paper sheet P with a print command from the user as a trigger. The image forming process is performed, for example, if the image data received through the interface 122 is printed, or if the image data generated by the scanner 15 is printed.

Next, the image forming process of the image forming device 10 will be described. The image forming device 10 performs the image forming process to form an image to the paper sheet P when receiving a print command from the user. In the image forming process, as illustrated in FIG. 1, the paper sheet P is taken out from the sheet cassette 18 by the pickup roller 18*a* and carried between the intermediate transfer belt 21 and the secondary transfer roller 33 by the sheet feeding roller 35.

In parallel to the above operation, the toner image is formed in the photosensitive drum 22 of each of the image forming units 20Y, 20M, 20C, and 20K. The toner images formed in the photosensitive drums 22 of the image forming units 20Y, 20M, 20C, and 20K are transferred sequentially to the intermediate transfer belt 21. With this configuration, the toner images made of Yellow (Y) toner, Magenta (M) toner, Cyan (C) toner, and Black (K) toner are formed on the intermediate transfer belt 21.

When the paper sheet P carried between the intermediate transfer belt 21 and the secondary transfer roller 33 passes through the intermediate transfer belt 21 and the secondary transfer roller 33, the toner image formed in the intermediate transfer belt 21 is transferred to the paper sheet P. With this configuration, the toner images made of Yellow (Y), Magenta (M), Cyan (C), and Black (K) toner are formed in the paper sheet P.

The paper sheet P with the toner image formed thereon passes through the fixing device 50. At this time, the fixing control circuit 150 controls the output of the heating coil 60 according to the size of the paper sheet P. The paper sheet P is heated as passing through the fixing device 50. With this configuration, the toner image transferred to the paper sheet P is fixed to the paper sheet P, and an image is formed on the paper sheet P. The paper sheet P with an image formed thereon is discharged to the sheet discharge unit 38 by the sheet discharge roller 37. In the image forming process, the above process is performed as many times as the number of copies.

As described above, in the fixing device 50 according to this embodiment, the magnetic shunt member 70 slides along the inner circumferential surface of the fixing belt 51 when the fixing belt 51 rotates, and swings about a fulcrum of the support member 82. As a result, the magnetic shunt member 70 repeatedly moves between the position indicated with a broken line and the position indicated with a solid line in FIG. 10, and the convex portion 92 of the lubricant supply member 90 repeatedly expands and contracts. Therefore, the silicon oil as much as a contracting amount or the number of expanding and contracting flows from the lubricant supply member 90 as the fixing belt 51 rotates, and is supplied to the inner circumferential surface of the fixing belt 51. Therefore, it is possible to reduce a friction force and maintain a lubricating property between the pressing pad 81 and the fixing belt 51. As a result, it is possible to keep the operation of the fixing device 50 smooth, and to expand a life span of the device.

Specifically, a lubricant such as silicon oil is sufficiently coated on the inner circumferential surface of the fixing belt when the fixing device is assembled. However, the lubricant flows out from the ends of the fixing belt to become insufficient during the course of the rotation of the fixing belt. As a result, the sliding property between the fixing belt and the pressing pad is degraded. Even if the amount of coating lubricant is increased at the time of assembling the fixing device, only the amount of lubricant flowing out at the time of operating and assembling the device is increased. Therefore, the effect of increasing the lubricant contributing to maintaining the lubricating property is not improved. In the fixing device according to this embodiment, the lubricant can be continuously supplied, so that the lubricity of the fixing belt can be kept for a long time.

In addition, in the fixing device 50 according to this embodiment, the lubricant coated on the inner circumferential surface of the fixing belt 51 is transferred to the base member 80 and the support plate 83, and dropped to and trapped in the lubricant supply member 90 located on the lower side. In the fixing device 50, the lubricant returned to the lubricant supply member 90 is supplied to the inner circumferential surface of the fixing belt 51 again at a proper timing. With this configuration, the lubricating property can be kept for a longer time.

The image forming device 10 according to this embodiment includes the fixing device 50. Therefore, it is possible to continuously form an image with accuracy.

Hitherto, an exemplary embodiment is described, but the embodiment is not limited thereto. For example, in the above embodiments, as illustrated in FIG. 9, three lubricant supply members 90 are provided in the fixing device 50. The exemplary embodiment is not limited to the above configuration, and four or more lubricant supply members 90 may be provided in the fixing device 50.

In addition, the layout positions of the lubricant supply members 90 may be densely provided at the center portion of the fixing belt 51 in consideration that the lubricant flows from both ends of the fixing belt 51 to the outside for example. In addition, the layout may be appropriately determined according to the structure of the image forming device.

In the above embodiments, the fixing belt 51 is heated using the electromagnetic induction of the heating coil 60. The exemplary embodiment is not limited to the above configuration, and the fixing belt 51 may be heated using a halogen heater, a ceramic heater or the like. In this case, it is possible to allow the magnetic shunt member 70 to serve as a heat accumulating member for increasing a heat capacity of the fixing belt 51. As a heat accumulating member, there may be used metal or a material obtained by molding a heat accumulating gel with metal for example.

Figure 12:
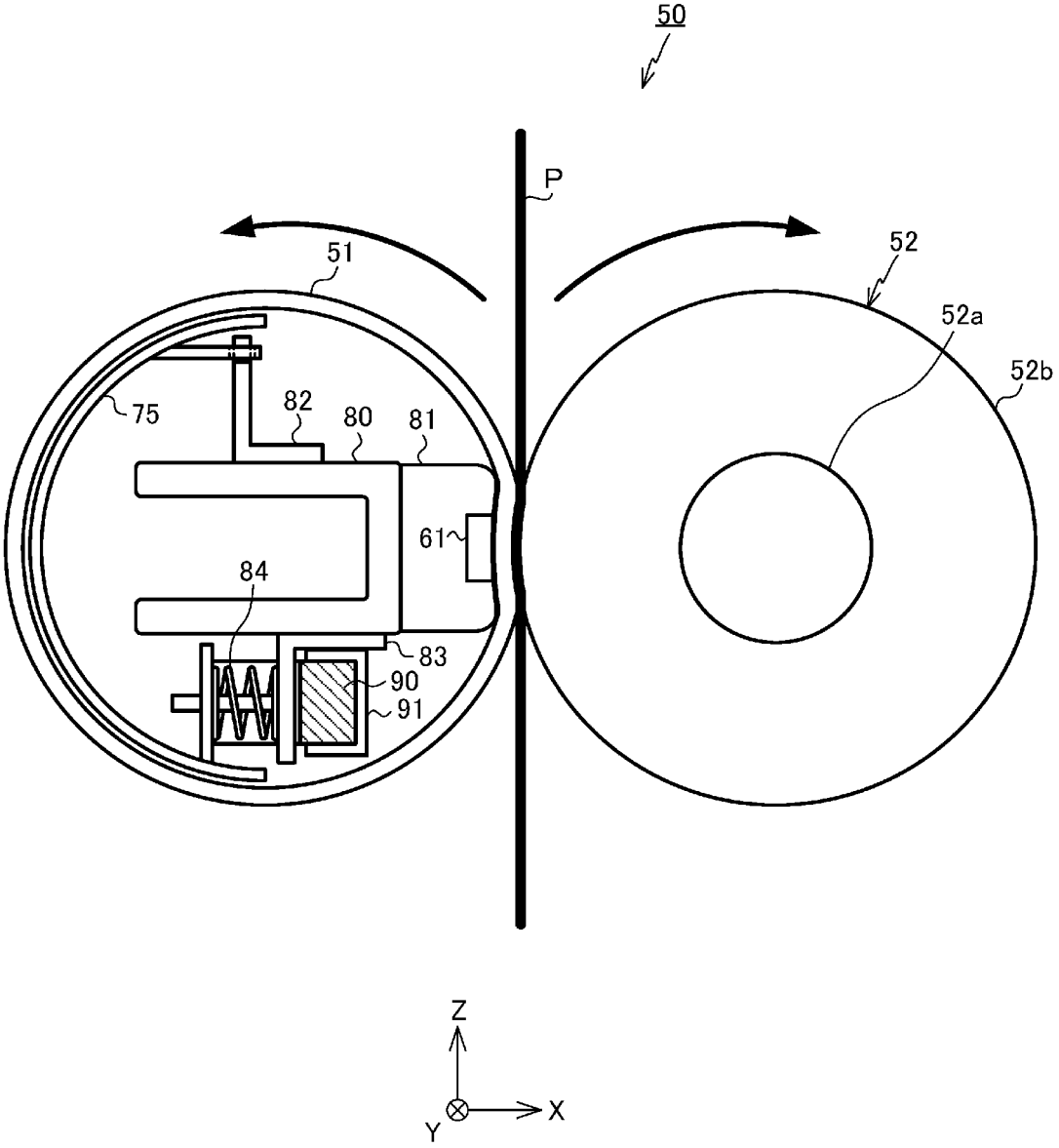
FIG. 12 is a diagram illustrating a modification of the fixing device.

FIG. 12 is a diagram illustrating an example where the fixing device 50 uses a heater 61 to heat the paper sheet P through the film-shaped fixing belt 51. The heater 61 includes a ceramic base plate and a heating portion formed in the base plate for example. In this fixing device 50, the heater 61 heats the paper sheet P by applying heat to the paper sheet P through the fixing belt 51. In this case, an auxiliary heating member 75 made of an excellent heat accumulating material is used instead of the magnetic shunt member 70, so that the temperature of the fixing belt 51 can be kept.

In the above embodiments, the fixing device 50 includes the fixing belt 51 of the cylindrical shape. The shape of the fixing belt 51 is not limited. For example, as illustrated in FIG. 13, a fixing device 500 which includes the fixing belt 51 stretched on a plurality of rollers may be used as the fixing device of the image forming device 10.

Figure 13:
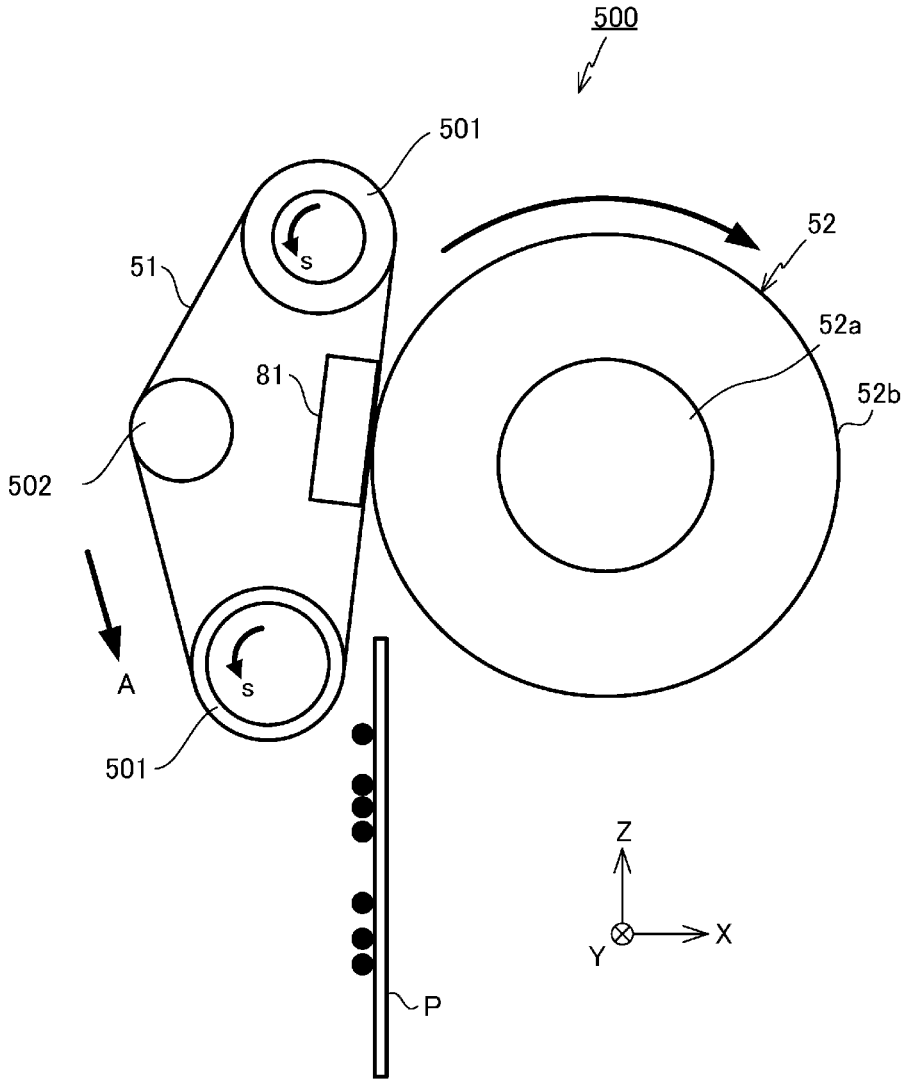
FIG. 13 is a diagram illustrating a modification of a fixing belt.

As illustrated in FIG. 13, in the fixing device 500, the fixing belt 51 is stretched on a driving roller 501 for rotating the fixing belt 51, and a tension roller 502 which applies tension to the fixing belt 51. The fixing belt 51 rotates in a direction indicated with arrow A when the driving rollers 501 rotate in a direction indicated with arrow s.

In the fixing device 500, a nip portion is formed between the fixing belt 51 and the pressing roller 52 when the pressing roller 52 is pressed to the pressing pad 81 which abuts on the inner side of the fixing belt 51. The paper sheet P with the toner image transferred thereon passes upward through the nip portion, and the paper sheet P is heated. With this configuration, the toner image is fixed to the paper sheet P, and an image is formed on the paper sheet P.

In the above embodiments, the description is given about a case where the image forming device 10 is a multi-function peripheral. The exemplary embodiment is not limited to the above configuration, and the image forming device 10 may be a laser printer.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing device that fixes a toner image formed on a medium to the medium, comprising:

a heating rotator configured to be rotatably supported;

a lubricant supply member comprising a lubricant;

a pressing rotator configured to abut on the heating rotator, and to form a nip portion through which the medium passes;

an abutting member disposed along an inner circumferential surface of the heating rotator, configured to move as the heating rotator rotates, and configured to abut on the lubricant supply member; and an elastic member configured to press the abutting member to the heating rotator.

2. The device according to claim 1, further comprising:

a heating coil disposed to face the abutting member with the heating rotator interposed therebetween, and configured to heat the heating rotator.

3. The device according to claim 2, wherein the abutting member comprises a magnetic shunt member.

4. The device according to claim 1, wherein the heating rotator has a cylindrical shape.

5. The device according to claim 4, wherein the abutting member bends along the inner circumferential surface of the heating rotator.

6. The device according to claim 5, wherein the abutting member has a semicircular shape.

7. The device according to claim 1, wherein the abutting member is supported such that one end thereof in a direction perpendicular to an axis parallel to the inner circumferential surface of the heating rotator is configured to move.

8. The device according to claim 7, wherein
the heating rotator is horizontally supported, and
the abutting member is supported such that an upper end is configured to move.

9. The device according to claim 1, wherein
a plurality of lubricant supply members are provided, and
the plurality of the lubricant supply members are arranged in an axial direction parallel to the inner circumferential surface of the heating rotator.

10. The device according to claim 1, wherein the abutting member comprises a metal material to accumulate a heat.

11. An image forming device, comprising:
a transfer body configured to transfer a toner image to a medium which is carried in a conveyance direction;
a toner image forming unit configured to form the toner image on the transfer body; and
a fixing device configured to heat the medium to which the toner image is transferred by the transfer body, and to fix the toner image to the medium,
the fixing device comprising:
a heating rotator configured to be rotatably supported,
a plurality of lubricant supply members arranged in an axial direction parallel to the inner circumferential surface of the heating rotator, and comprising a lubricant, and
a pressing rotator configured to abut on the heating rotator, and to form a nip portion through which the medium passes,
an abutting member
disposed along an inner circumferential surface of the heating rotator,
configured to move about an axis parallel to the inner circumferential surface of the heating rotator, and
configured to abut on the lubricant supply member.

12. The device according to claim 11, further comprising:
a heating coil disposed to face the abutting member with the heating rotator interposed therebetween, and configured to heat the heating rotator.

13. The device according to claim 11, further comprising:
an elastic member configured to press the abutting member to the heating rotator.

14. The device according to claim 11, wherein the abutting member comprises a magnetic shunt member.

15. The device according to claim 11, wherein
the heating rotator has a cylindrical shape, and
the abutting member bends along the inner circumferential surface of the heating rotator.

16. The device according to claim 15, wherein the abutting member has a semicircular shape.

17. The device according to claim 11, wherein the abutting member is supported such that one end thereof in a direction perpendicular to an axis parallel to the inner circumferential surface of the heating rotator is configured to move.

18. The device according to claim 17, wherein
the heating rotator is horizontally supported, and
the abutting member is supported such that an upper end is configured to move.

19. The device according to claim 17, wherein the abutting member moves as the heating rotator rotates.

20. The device according to claim 11, wherein the abutting member is a heat accumulating member which comprises a metal material.

* * * * *